US008774437B2

(12) United States Patent
Nakamura et al.

(10) Patent No.: US 8,774,437 B2
(45) Date of Patent: Jul. 8, 2014

(54) SPEAKER BOX AND SPEAKER DEVICE

(75) Inventors: Takeshi Nakamura, Uji (JP); Takao Mouri, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 1925 days.

(21) Appl. No.: 11/937,766

(22) Filed: Nov. 9, 2007

(65) Prior Publication Data

US 2008/0089543 A1 Apr. 17, 2008

Related U.S. Application Data

(63) Continuation of application No. PCT/JP2006/302938, filed on Feb. 20, 2006.

(30) Foreign Application Priority Data

May 17, 2005 (JP) ..... 2005-143880

(51) Int. Cl.
*H04R 1/20* (2006.01)

(52) U.S. Cl.
USPC ..... 381/337; 381/338; 381/345; 381/346

(58) Field of Classification Search
USPC ..... 381/337
See application file for complete search history.

(56) References Cited

U.S. PATENT DOCUMENTS 6,763,117 B2 * 7/2004 Goldslager et al. ..... 381/345

FOREIGN PATENT DOCUMENTS

| | | | |
|---|---|---|---|
| DE | 198 36 790 | C1 | 4/1999 |
| JP | 60-57798 | A | 4/1985 |
| JP | 06-351087 | A | 12/1994 |
| JP | 09-9384 | A | 1/1997 |
| JP | 11-252672 | A | 9/1999 |
| JP | 2003-204586 | A | 7/2003 |

OTHER PUBLICATIONS

Official communication issued in counterpart German Application No. 11 2006 001 232.0, mailed on Apr. 22, 2009.

* cited by examiner

*Primary Examiner* — Matthew Eason
(74) *Attorney, Agent, or Firm* — Keating & Bennett, LLP

(57) ABSTRACT

A speaker box and a speaker device that can be manufactured at low cost and that provide a sound-absorbing effect. A speaker box of a speaker device includes a baffle, four intermediate plates, and a rear plate. The baffle plate has a speaker mount hole at the center. Each intermediate plate has a hole. The intermediate plates are stacked such that they are alternately reversed or rotated so that the holes in the adjacent intermediate plates communicate with each other while the holes are shifted from with each other. A hollow space with a sound-absorbing effect is formed by the holes in the speaker box.

13 Claims, 8 Drawing Sheets

SPEAKER BOX AND SPEAKER DEVICE

CROSS-REFERENCE TO RELATED APPLICATIONS

This is a continuation under 35 U.S.C. §111(a) of PCT/JP2006/302938 filed Feb. 20, 2006 and claims priority of JP2005-143880 filed May 17, 2005, incorporated by reference.

BACKGROUND

1. Technical Field

Disclosed are speaker boxes and speaker devices, and more particularly, a speaker box formed by stacking and joining a plurality of plates and a speaker device including the speaker box.

2. Background Art

As an example of a speaker system formed by stacking and joining a plurality of plates, a labyrinth-type speaker system is known (see Patent Document 1). This speaker system includes a laminate obtained by alternately stacking a separation plate and a laminated member having a corrugated core for providing air paths interposed therein; a plurality of air chambers provided in the laminate; and a speaker mount hole formed in a surface of the laminate. A long, folded sound path is formed by the speaker mount hole, the air paths, and the air chambers.

In addition, as an example of a speaker box formed by stacking and joining a plurality of plates, a back-load horn speaker box is known (see Patent Document 2). This speaker box includes two side plates and a plurality of intermediate plates disposed between the side plates. Each of the intermediate plates has curved inner walls defining a winding sound path. The intermediate plates and the two side plates are stacked and joined together by bolts. Thus, a winding sound path defined by curved inner walls is formed in the main body of the speaker box.

In addition, as an example of a structure in which the shape of a sound path in a speaker box varies in an attachment direction of a sound source such as a speaker (traveling direction of sound waves), a device for reducing a standing wave or the like is known (see Patent Document 3). In this device, to reduce a standing wave or another particular wave generated between two parallel walls, a unit formed by stacking many hollow sound guide members having openings at one end thereof is disposed near a wall facing a sound source. The height of the openings in the hollow sound guide members is set to ¼ or less of the wavelength of the target sound wave, and the sound guide members are arranged such that the sound guide length thereof is reduced as the distance from the wall is increased.

As another example of a structure in which the shape of a sound path in a speaker box varies in an attachment direction of a speaker, a sound-damping acoustic speaker box is known (see Patent Document 4). The cross section of the acoustic box is reduced from that at the attachment position of the speaker toward the inside of the acoustic box. The acoustic box has a plurality of resistance plates attached thereto, and the resistance plates are arranged such that the area thereof is increased along a direction from the speaker to the port, so that the resistance plate at the port has a minimum opening area.

Patent Document 1: Japanese Unexamined Patent Application Publication No. 11-252672 (FIGS. 6 and 7)

Patent Document 2: Japanese Unexamined Patent Application Publication No. 2003-204586 (FIG. 1)

Patent Document 3: Japanese Unexamined Patent Application Publication No. 9-9384 (FIGS. 1 and 17)

Patent Document 4: Japanese Unexamined Patent Application Publication No. 60-57798 (FIG. 2)

SUMMARY

In the labyrinth-type speaker system according to Patent Document 1 and the back-load horn speaker box according to Patent Document 2, low-frequency components of the sound emitted from a rear surface of the speaker can be compensated for by resonance in the sound path and acoustic amplification. However, because the sound path is long, a time lag occurs between the sound output from the sound path and the sound emitted from a front surface of the speaker. Therefore, uniform acoustic characteristics cannot be obtained.

The device for reducing the standing wave according to Patent Document 3 and the sound-damping acoustic speaker box according to Patent Document 4 provide an effect of absorbing the sound emitted from the rear surface of the speaker. However, a complex structure including hollow sound guide members or resistance plates is required. Therefore, the manufacturing process is cumbersome and high manufacturing costs are incurred.

The labyrinth-type speaker system according to Patent Document 1 and the back-load horn speaker box according to Patent Document 2 also have a complex structure in which a plurality of plates are bonded together. Therefore, the manufacturing process is cumbersome and high manufacturing costs are incurred.

Accordingly, the inventors have developed a speaker box and a speaker device that can be manufactured at low cost and that provide a sound-absorbing effect.

A speaker box according to the present disclosure has a plurality of intermediate plates stacked and bonded together between a baffle plate and a rear plate such that the intermediate plates are perpendicular to a traveling direction of sound waves emitted from a rear surface of a speaker. The plurality of intermediate plates have respective holes, and the holes have the same size and the same shape. The plurality of intermediate plates are stacked such that the holes in the adjacent intermediate plates communicate with each other while the holes are shifted from each other.

In the speaker box, preferably, the plurality of intermediate plates have the same outer size and the same outer shape. In such a case, for example, the structure may be such that the outer shape of the plurality of intermediate plates is symmetrical about the centerline thereof, the shape of the holes formed in the plurality of intermediate plates is asymmetric about the centerline of the intermediate plates, and the plurality of intermediate plates are stacked such that the intermediate plates are alternately reversed. Alternatively, the structure may also be such that the outer shape of the plurality of intermediate plates is a regular polygon, the holes formed in the plurality of intermediate plates are shifted from the center of the intermediate plates, and the plurality of intermediate plates are stacked such that the intermediate plates are successively rotated by an angle, which may be a small or large angle as described hereinbelow.

In addition, in the speaker box, the holes are formed such that top, bottom, left and right walls of the speaker box are nonuniform.

A speaker device according to the present disclosure includes the speaker box described above, and a speaker attached to the baffle plate included in the speaker box.

In the speaker box, the plurality of intermediate plates are disposed between the baffle plate and the rear plate such that the intermediate plates are perpendicular to the traveling direction of sound waves emitted from the rear surface of the speaker. In addition, the holes having the same size and the same shape are formed in the plurality of intermediate plates. Thus, the holes formed in the intermediate plates may be of the same kind, and therefore the holes can be easily formed. Accordingly, the speaker box can be manufactured at low cost.

In addition, in the speaker box, the holes in the adjacent intermediate plates communicate with each other while the holes are shifted from each other. Therefore, a hollow space having irregular surfaces is formed by the holes formed in the intermediate plates. The hollow space provides a sound-absorbing function by diffusing the sound emitted from the rear surface from the speaker at the irregular surfaces.

In the speaker box, the intermediate plates may have the same outer size and the same outer shape. In such a case, the intermediate plates having the holes formed therein may be of the same kind, and therefore the manufacturing costs can be further reduced. In addition, the structure may be such that the outer shape of the plurality of intermediate plates is symmetrical about the centerline thereof, the shape of the holes formed in the plurality of intermediate plates is asymmetric about the centerline of the intermediate plates, and the plurality of intermediate plates are stacked such that the intermediate plates are alternately reversed. Alternatively, the structure may also be such that the outer shape of the plurality of intermediate plates is a regular polygon, the holes formed in the plurality of intermediate plates are shifted from the center of the intermediate plates, and the plurality of intermediate plates are stacked such that the intermediate plates are successively rotated. In such a case, a speaker box having smooth outer surfaces can be obtained.

In addition, in the speaker box, the holes may be formed such that top, bottom, left and right walls of the speaker box are nonuniform. In such a case, vibration that occurs due to pressure variation in the speaker box caused by vibration of the speaker in the front-rear direction and that causes resonance of the walls of the speaker box and resonant sound therefrom can be suppressed.

The disclosed speaker box and speaker device can be manufactured at low cost and provide a sound-absorbing effect.

The above and other objects, features, and advantages will become more apparent from the following description of embodiments, with reference to the drawings.

REFERENCE NUMERALS

Figure 1:
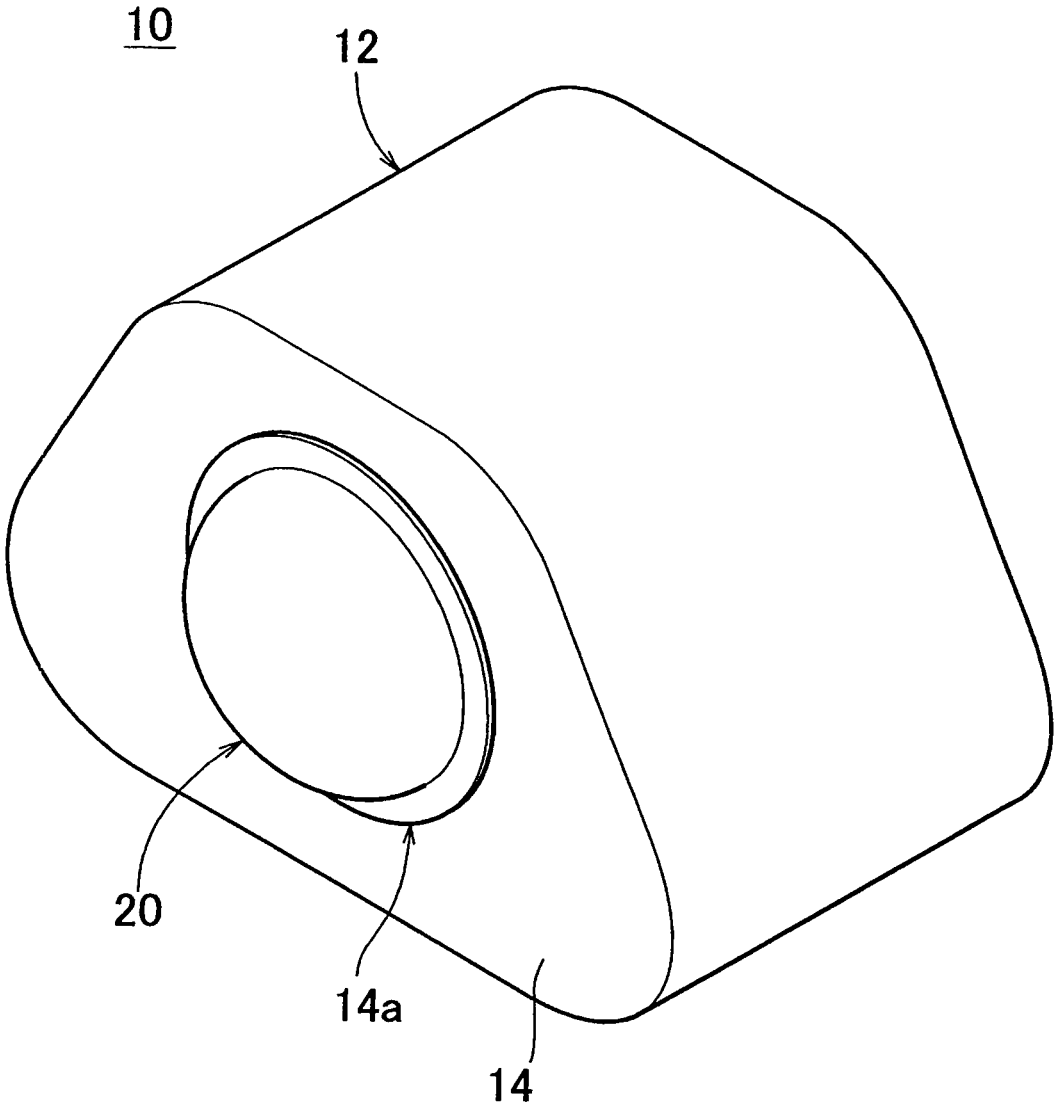
FIG. 1 is a perspective view illustrating an example of a speaker device.

10: speaker device
12: speaker box
14: baffle plate
14*a*: speaker mount hole
16: intermediate plate
16*a*: hole
18: rear plate
20: speaker

DETAILED DESCRIPTION

Figure 2:
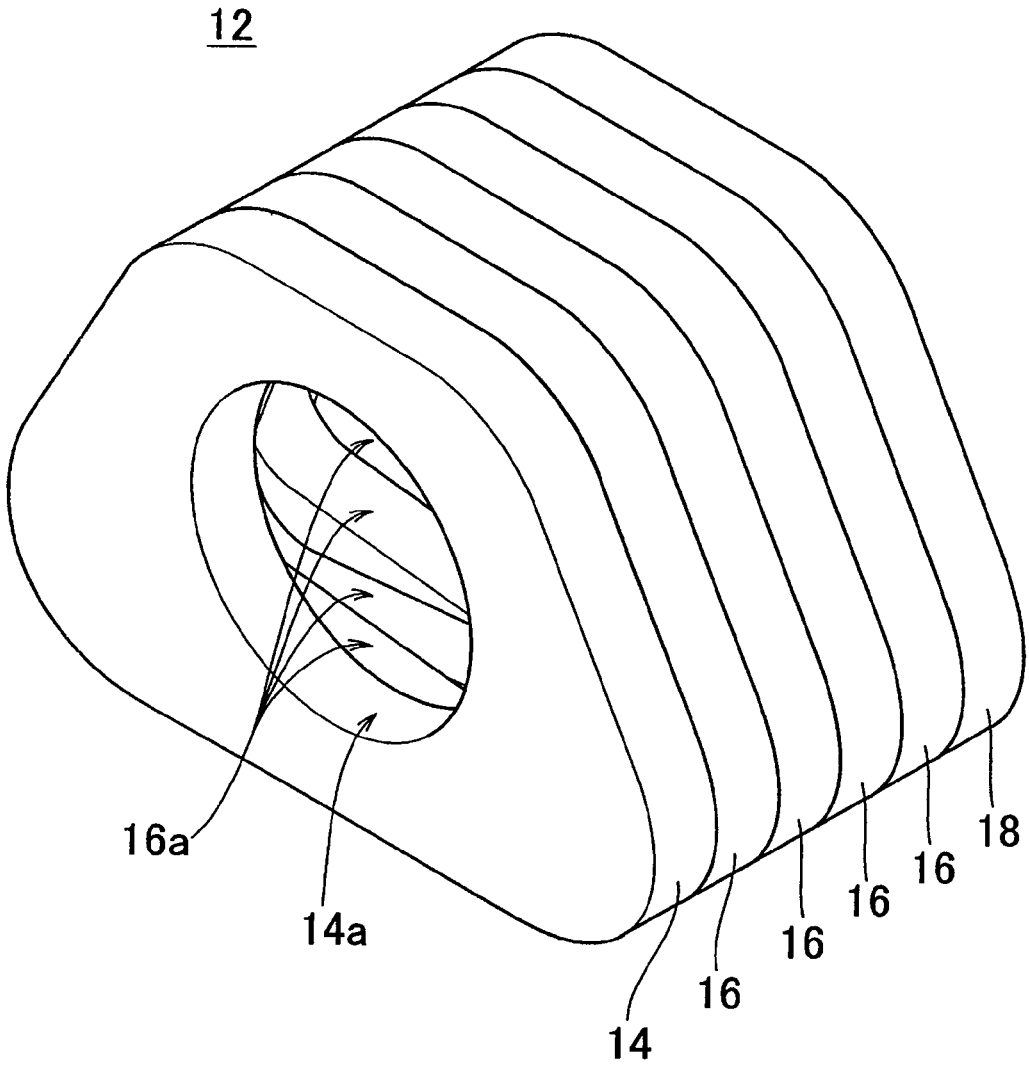
FIG. 2 is a perspective view of a speaker box included in the speaker device shown in FIG. 1.
Figure 3:
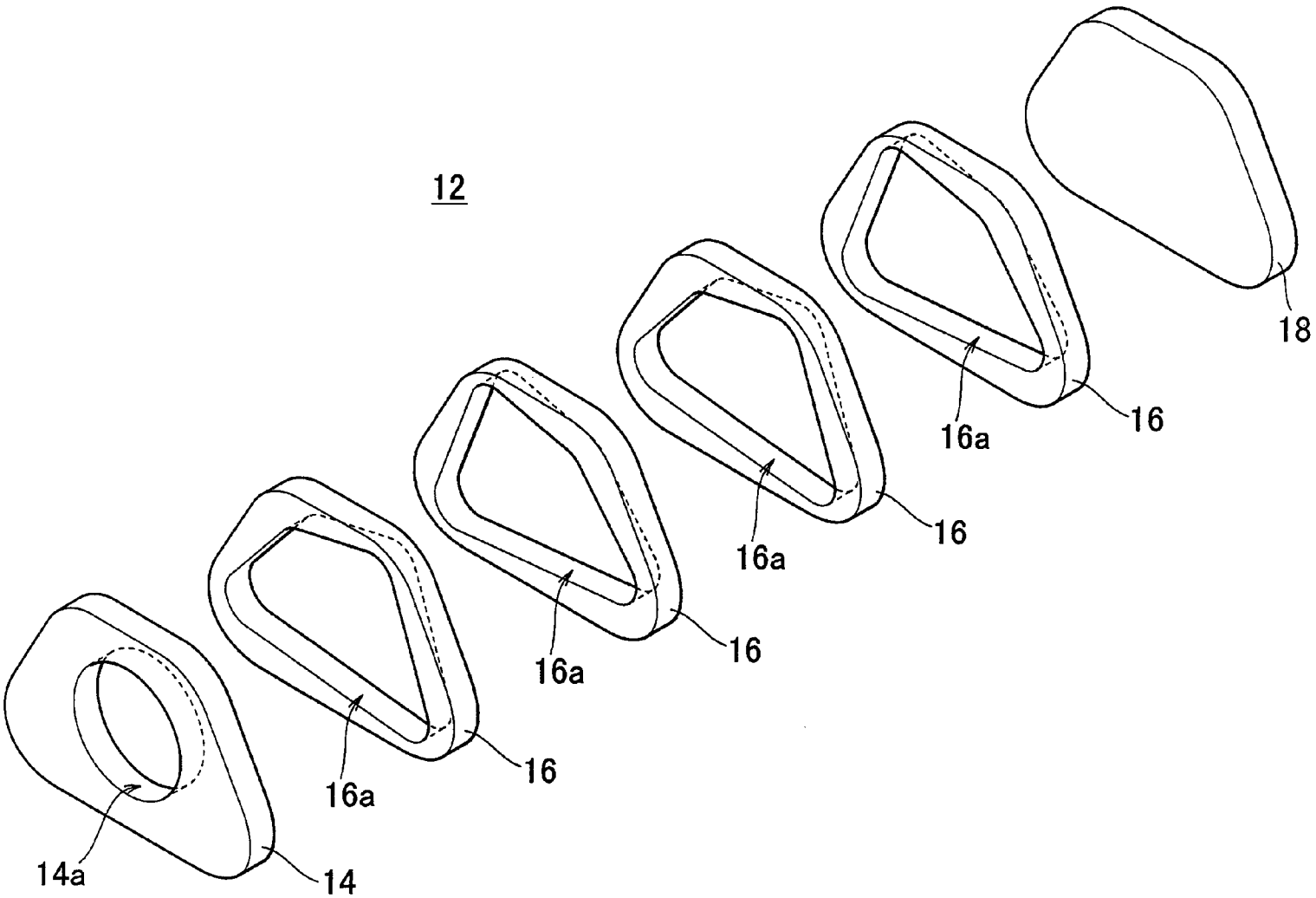
FIG. 3 is an exploded perspective view of the speaker box shown in FIG. 2.
Figure 4:
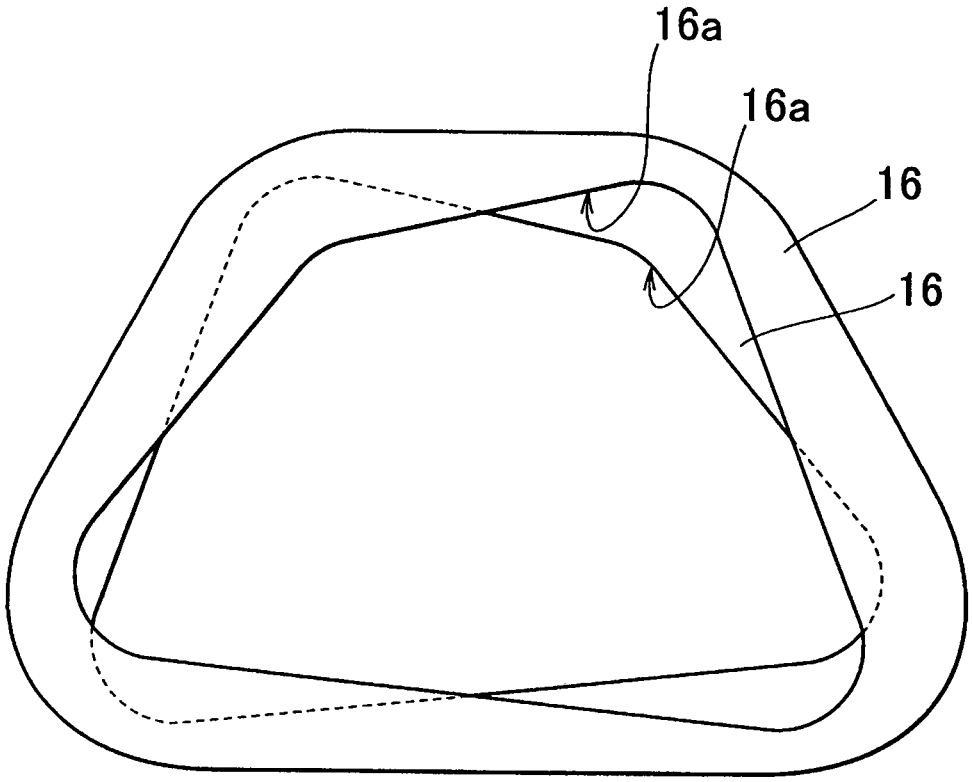
FIG. 4 is a diagram illustrating the relationship between holes formed in adjacent intermediate plates in the speaker box shown in FIG. 2.

FIG. 1 is a perspective view illustrating an example of a speaker device. FIG. 2 is a perspective view of a speaker box included in the speaker device shown in FIG. 1. FIG. 3 is an exploded perspective view of the speaker box shown in FIG. 2. FIG. 4 is a diagram illustrating the relationship between holes formed in adjacent intermediate plates in the speaker box shown in FIG. 2.

A speaker device 10 shown in FIG. 1 includes a speaker box 12 having the shape of a hollow column that is substantially trapezoidal in front view. As shown in FIGS. 2 and 3, the speaker box 12 includes a single baffle plate 14, four intermediate plates 16, 16, . . . , and a single rear plate 18.

The baffle plate 14 has a substantially trapezoidal shape that is symmetrical about the center line at the center in the width direction. The baffle plate 14 has, for example, a circular speaker mount hole 14*a* at the center.

The outer shape of the four intermediate plates 16, 16, . . . is the same substantially trapezoidal shape as that of the baffle plate 14. The intermediate plates 16, 16, . . . are provided with non-axisymmetric, quadrangular holes 16*a*, 16*a*, . . . having the same size. The intermediate plates 16, 16, . . . are stacked on a rear surface of the baffle plate 14 and are bonded together with an adhesive. At this time, the intermediate plates 16, 16, . . . are alternately reversed so that the holes 16*a*, 16*a* formed in the adjacent intermediate plates 16, 16 communicate with each other while being shifted from each other, as shown in FIG. 4. Thus, a hollow space having irregular surfaces is formed in the speaker box 12 by the holes 16*a*, 16*a*, . . . in the intermediate plates 16, 16, . . . such that the hollow space communicates with the speaker mount hole 14*a* in the baffle plate 14. Although the hole 16*a* in each intermediate plate 16 has a relatively large area, the area of the holes 16*a* is reduced in the state in which the intermediate plates 16, 16, . . . are bonded together because the holes 16*a* are partially blocked by the intermediate plates 16.

The rear plate 18 has the same substantially trapezoidal shape as that of the baffle plate 14 and the intermediate plates 16. The rear plate 18 is placed on the rearmost intermediate plate 16 and is bonded thereto with an adhesive.

The rear plate 18 may also be fixed to the baffle plate 14 and the four intermediate plates 16, 16, . . . with bolts instead of or in addition to using the adhesive.

As shown in FIG. 1, a speaker 20 including a piezoelectric ceramic vibrator having, for example, a hemispherical shape is attached to the speaker mount hole 14*a* formed in the baffle plate 14 of the speaker box 12 shown in FIGS. 2 and 3.

In the speaker device 10 shown in FIG. 1, the number of different kinds of plates forming the speaker box 12 is small. In particular, the four intermediate plates 16, 16, . . . having the holes 16*a*, 16*a*, . . . formed therein and disposed perpendicular to the traveling direction of sound waves emitted from a rear surface of the speaker 20 are of the same kind. Therefore, the manufacturing costs can be reduced.

In addition, in the speaker device 10 shown in FIG. 1, a hollow space having irregular surfaces is formed by the holes 16*a*, 16*a*, . . . in the four intermediate plates 16, 16, . . . in the speaker box 12. The size of the hollow space defined by the irregular surfaces varies in a direction perpendicular to the traveling direction of the sound waves emitted from the rear surface of the speaker 20. Therefore, a sound-absorbing effect can be obtained by diffusing the sound emitted from the rear surface of the speaker 20 at the irregular surfaces. As a result, it is not necessary to use a sound-absorbing material.

In addition, in the speaker device 10 shown in FIG. 1, the holes 16, 16*a*, . . . are formed such that the top, bottom, left and right walls of the speaker box 12 have nonuniform thickness. Therefore, vibration of the walls of the speaker box 12 due to pressure variation in the speaker box 12 caused by vibration of the speaker 20 in the front-rear direction can be suppressed. In particular, vibration that causes resonance of the walls of the speaker box 12 and resonant sound therefrom can be suppressed.

In addition, in the speaker device 10 shown in FIG. 1, the four intermediate plates 16, 16, . . . included in the speaker box 12 are of the same kind. However, by stacking the intermediate plates 16, 16, . . . such that they are alternately reversed, a complex-shaped hollow space having irregular surfaces is formed in the speaker box 12. In addition, the speaker box 12 has smooth exterior surfaces.

Figure 5:
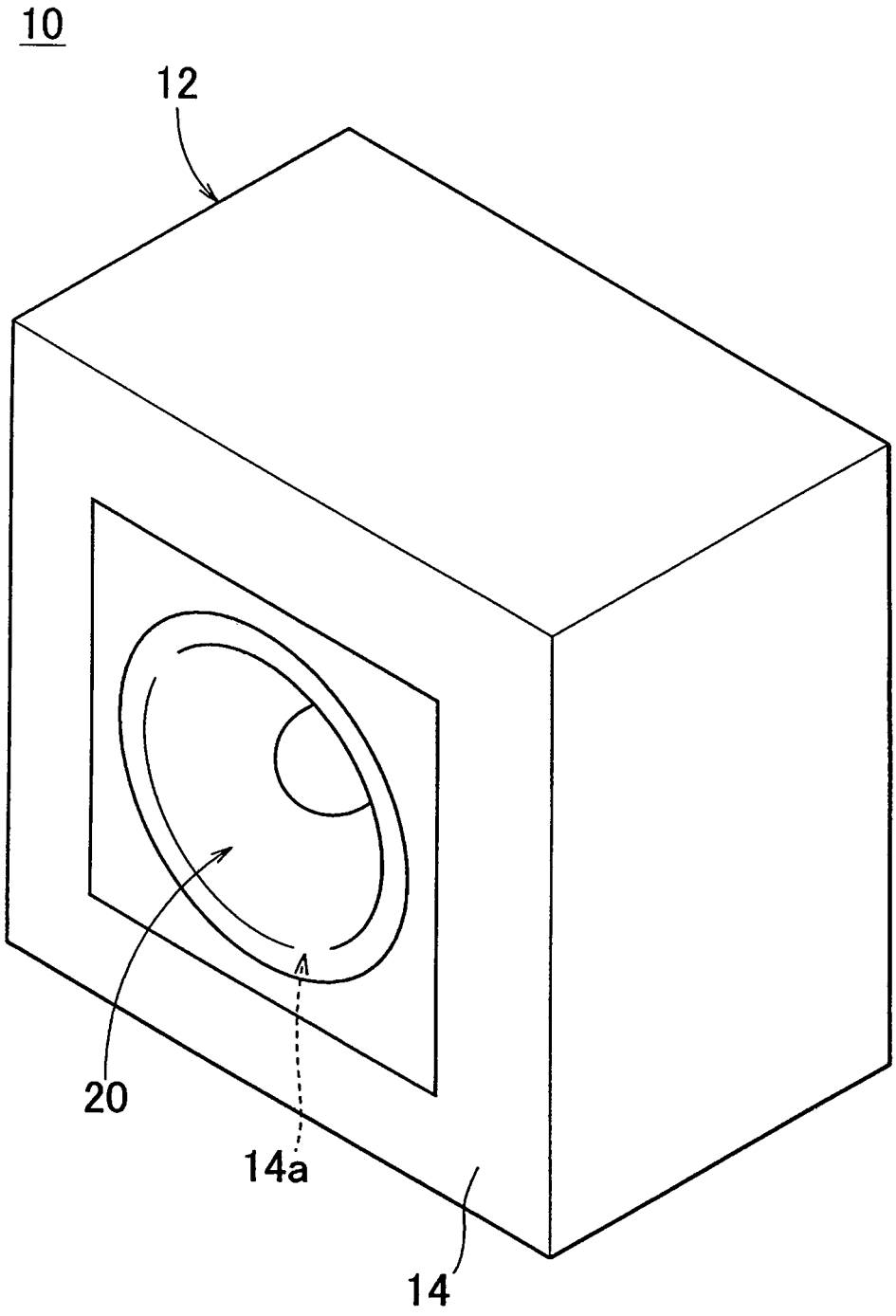
FIG. 5 is a perspective view illustrating another example of a speaker device.
Figure 6:
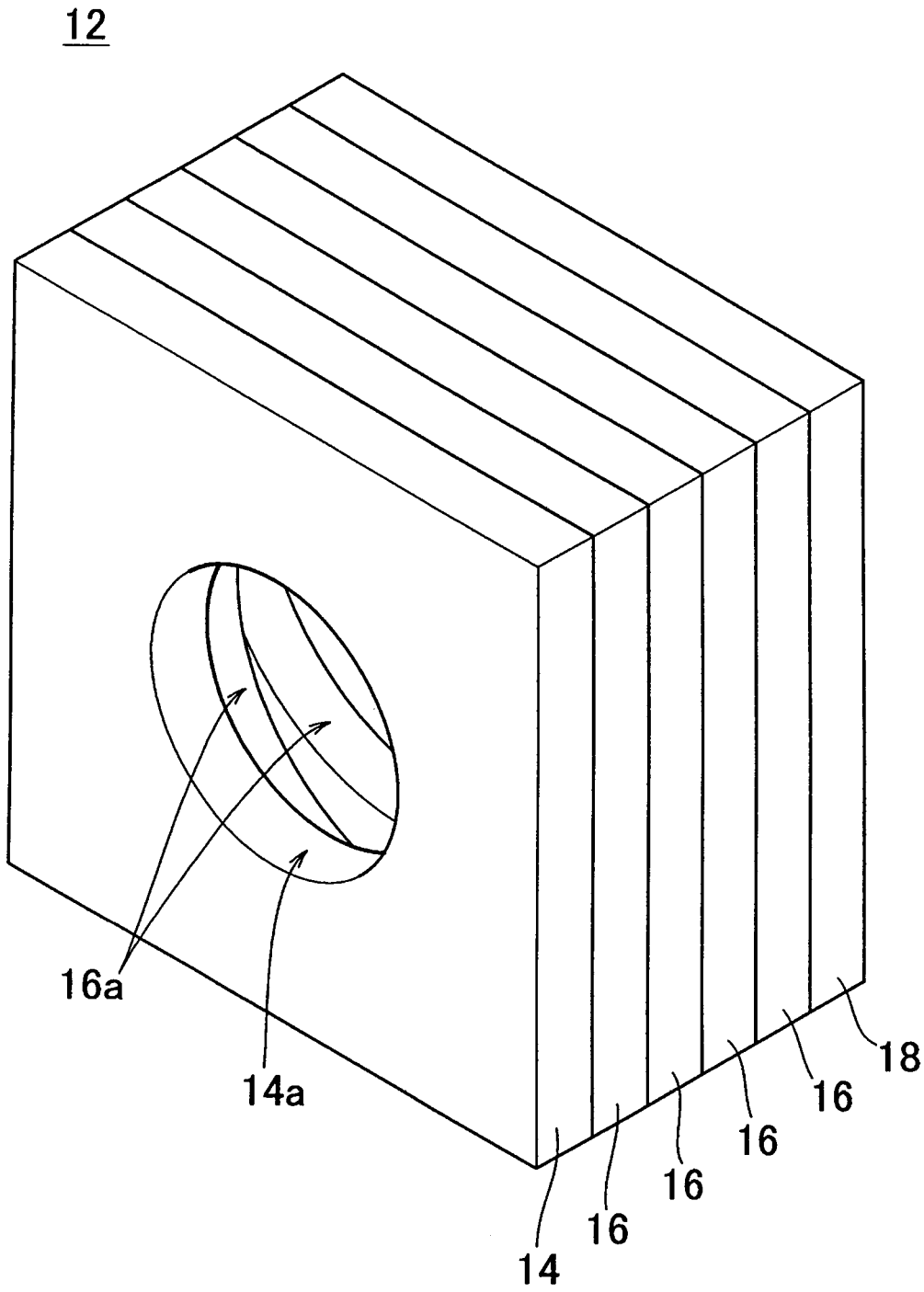
FIG. 6 is a perspective view of a speaker box included in the speaker device shown in FIG. 5.
Figure 7:
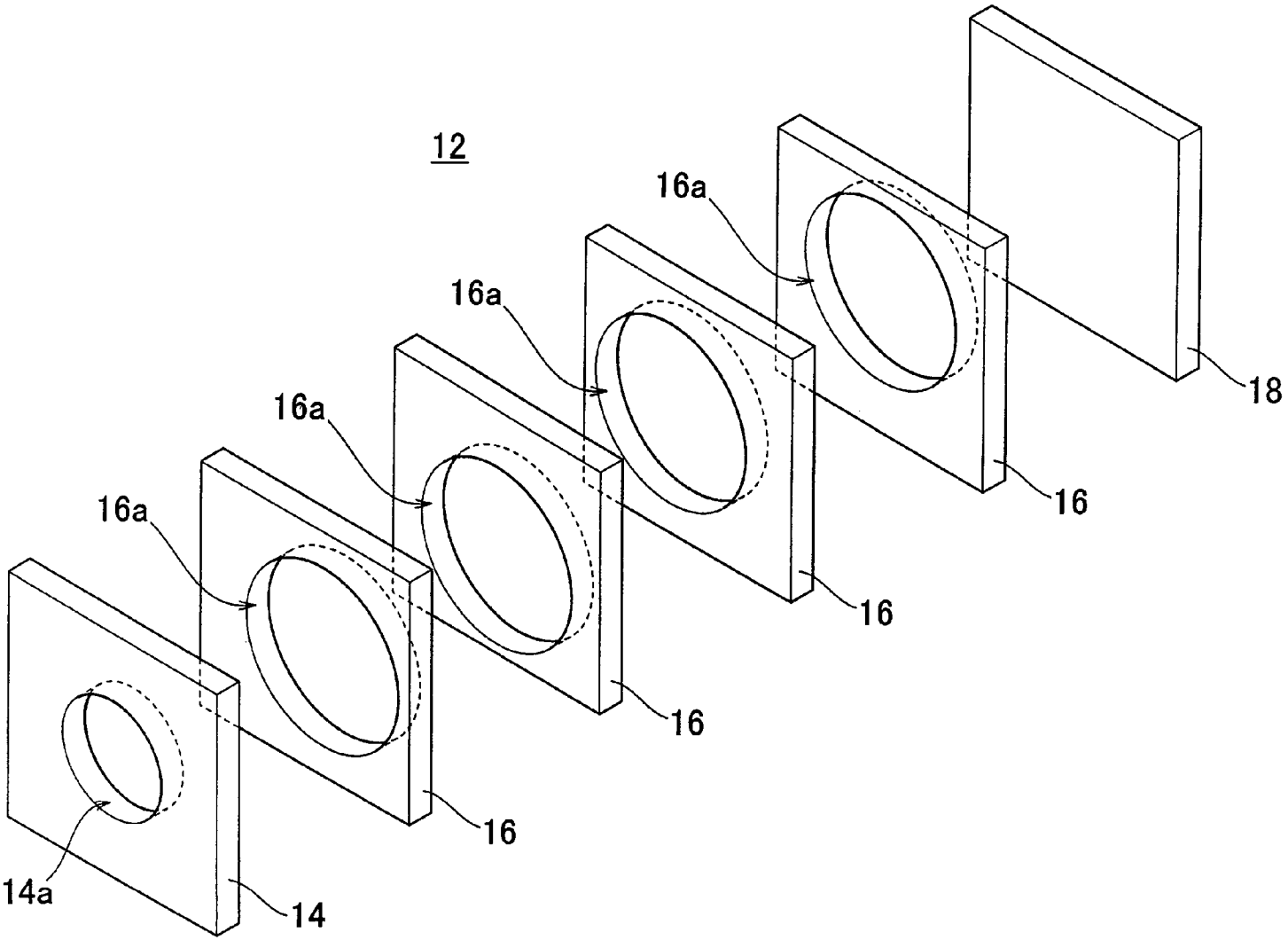
FIG. 7 is an exploded perspective view of the speaker box shown in FIG. 6.
Figure 8:
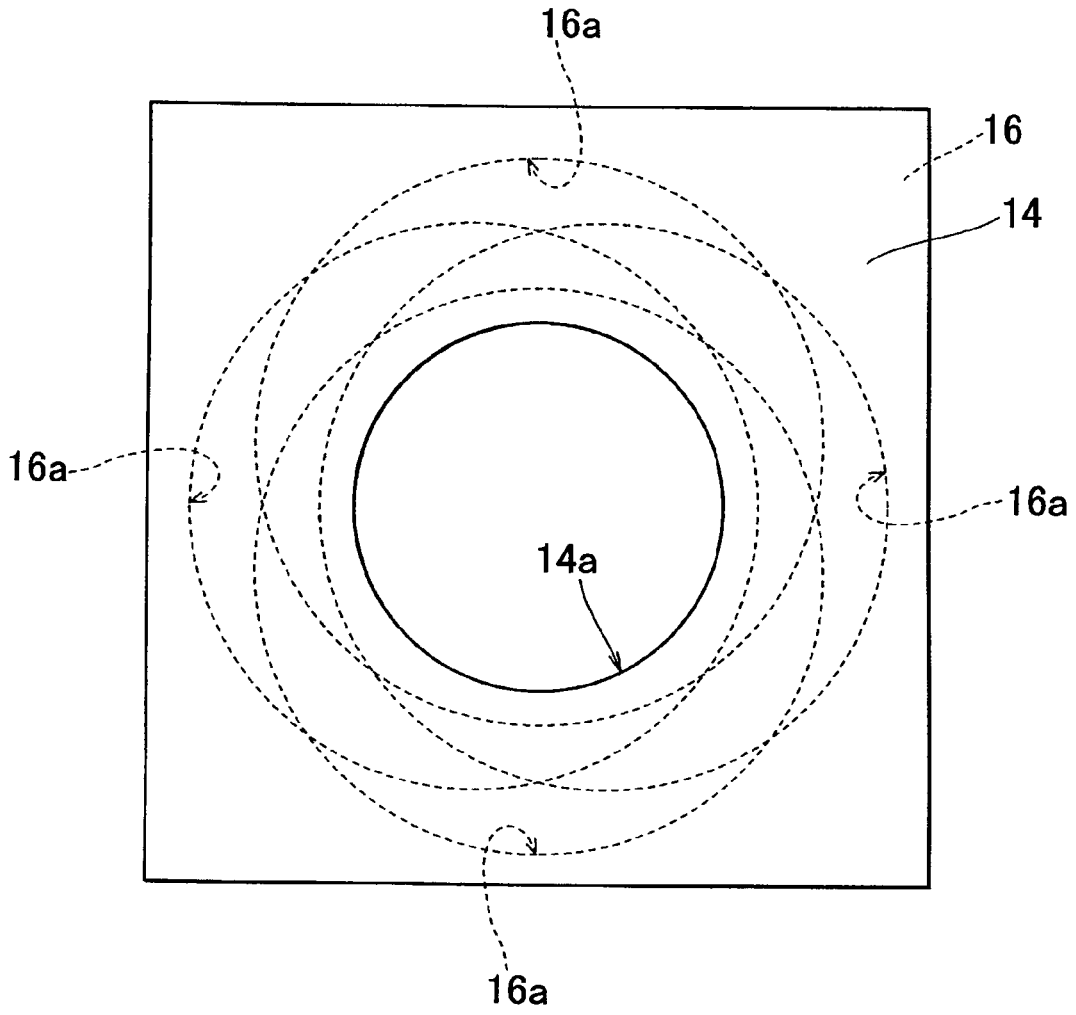
FIG. 8 is a diagram illustrating the relationship between holes formed in adjacent intermediate plates in the speaker box shown in FIG. 6.

FIG. 5 is a perspective view illustrating another example of a speaker device. FIG. 6 is a perspective view of a speaker box included in the speaker device shown in FIG. 5. FIG. 7 is an exploded perspective view of the speaker box shown in FIG. 6. FIG. 8 is a diagram illustrating the relationship between holes formed in adjacent intermediate plates in the speaker box shown in FIG. 6.

A speaker device 10 shown in FIG. 5 includes a speaker box 12 having, for example, a hollow, rectangular parallelepiped shape. As shown in FIGS. 6 and 7, the speaker box 12 includes a single baffle plate 14, four intermediate plates 16, 16, . . . , and a single rear plate 18. The baffle plate 14, each intermediate plate 16, and the rear plate 18 have the same square shape with the same size. The baffle plate 14 has, for example, a circular speaker mount hole 14*a* at the center. Each of the four intermediate plates 16, 16, . . . has, for example, a circular hole 16*a* at a position slightly shifted from the center toward one of the sides. The baffle plate 14, the intermediate plates 16, 16, . . . and the rear plate 18 are stacked and bonded together with an adhesive. As shown in FIG. 8, the four intermediate plates 16, 16, . . . are stacked on a rear surface of the baffle plate 14 such that the holes 16*a*, 16*a*, . . . communicate with the speaker mount hole 14*a* formed in the baffle plate 14. In addition, the four intermediate plates 16, 16, . . . are stacked such that they are successively rotated by 90°, so that the holes 16*a*, 16*a* formed in the adjacent intermediate plates 16, 16 communicate with each other while the holes 16*a*, 16*a* are shifted from each other.

As shown in FIG. 5, a speaker 20 including a cone, a voice coil, and a permanent magnet is attached to the speaker mount hole 14*a* formed in the baffle plate 14 of the speaker box 12 shown in FIGS. 6 and 7.

Also in the speaker device 10 shown in FIG. 5, similar to the speaker device 10 shown in FIG. 1, the four intermediate plates 16, 16, . . . included in the speaker box 12 are of the same kind. However, a complex-shaped hollow space having irregular surfaces is formed in the speaker box 12 and the speaker box 12 has smooth exterior surfaces. Therefore, the manufacturing costs can be reduced. In addition, a sound-absorbing effect of absorbing the sound emitted from the rear surface of the speaker 20 can be obtained. Furthermore, vibration that occurs due to pressure variation in the speaker box 12 caused by vibration of the speaker 20 in the front-rear direction and that causes resonance of the walls of the speaker box 12 and resonant sound therefrom can be suppressed.

In the above-described speaker devices 10, four intermediate plates 16, 16, . . . , are included in the speaker box 12. However, the number of the intermediate plates is not limited to four.

In addition, in the above-described speaker devices 10, the intermediate plates 16, 16, . . . are stacked such that they are alternately reversed or successively rotated by 90°, so that the holes 16*a*, 16*a* formed in the adjacent intermediate plates 16, 16 communicate with each other while the holes 16*a*, 16*a* are shifted from each other. Alternatively, however, the intermediate plates 16, 16, . . . may also be stacked such that they are successively rotated by an angle other than 90° or such that the adjacent intermediate plates 16, 16 are shifted from each other in at least one of the top-bottom direction and the left-right direction. In the case in which the intermediate plates 16, 16, . . . are stacked such that they are successively rotated by an angle other than 90°, each intermediate plate 16 may be formed in regular polygonal shapes other than square. If, for example, each intermediate plate 16 is formed in a regular hexagonal shape, the intermediate plates 16, 16, . . . may be stacked such that they are successively rotated by 60°. Accordingly, a speaker box 12 having smooth outer surfaces can be obtained.

In addition, in the above-described speaker devices 10, the intermediate plates 16, 16, . . . included in the speaker box 12 have a substantially trapezoidal or square outer shape. However, the outer shape of the intermediate plates may also be other shapes, such as non-regular polygonal shapes and circular shapes.

In addition, in the above-described speaker devices 10, the hole 16*a* formed in each intermediate plate 16 has a substantially quadrangular shape or a circular shape. However, the hole shape may also be other shapes, e.g., a polygonal shape such as square, as long as the holes formed in the adjacent intermediate plates can communicate with each other while they are shifted from each other.

In the above-described speaker devices 10, it is not necessary to use a sound-absorbing material to obtain a sound-absorbing effect. However, a sound-absorbing material may be provided in the speaker box 12 to enhance the sound-absorbing effect.

The speaker box and the speaker device are used in, for example, an audio stereo system.

Although particular embodiments have been described, many other variations and modifications and other uses will become apparent to those skilled in the art. Therefore, the present invention is not limited by the specific disclosure herein.

What is claimed is:

1. A speaker box having a plurality of intermediate plates stacked and bonded together between a baffle plate and a rear plate such that the intermediate plates are perpendicular to a traveling direction of sound waves emitted from a rear surface of a speaker, wherein the plurality of intermediate plates have respective holes, the holes having the same size and the same shape, and wherein the plurality of intermediate plates are stacked such that the holes in the adjacent intermediate plates communicate with each other while the holes are shifted from each other.

2. The speaker box according to claim 1, wherein the plurality of intermediate plates have the same outer size and the same outer shape.

3. The speaker box according to claim 2, wherein the outer shape of the plurality of intermediate plates is symmetrical about the centerline thereof, wherein the shape of the holes formed in the plurality of intermediate plates is asymmetric about the centerline of the intermediate plates, and wherein the plurality of intermediate plates are stacked such that the intermediate plates are alternately reversed about said centerline.

4. The speaker box according to claim 2, wherein the outer shape of the plurality of intermediate plates is a regular polygon, wherein the holes formed in the plurality of intermediate plates are shifted from the center of the intermediate plates, and wherein the plurality of intermediate plates are stacked such that the intermediate plates are successively rotated.

5. The speaker box according to claim 1, wherein the holes are formed such that top, bottom, left and right walls of the speaker box are nonuniform in thickness.

6. The speaker box according to claim 2, wherein the holes are formed such that top, bottom, left and right walls of the speaker box are nonuniform in thickness.

7. The speaker box according to claim 3, wherein the holes are formed such that top, bottom, left and right walls of the speaker box are nonuniform in thickness.

8. The speaker box according to claim 4, wherein the holes are formed such that top, bottom, left and right walls of the speaker box are nonuniform in thickness.

9. A speaker device comprising:

the speaker box according to claim 1; and a speaker attached to the baffle plate included in the speaker box.

10. The speaker device according to claim 9, wherein the holes are formed such that top, bottom, left and right walls of the speaker box are nonuniform in thickness.

11. The speaker device according to claim 9, wherein the plurality of intermediate plates have the same outer size and the same outer shape.

12. The speaker device according to claim 11, wherein the outer shape of the plurality of intermediate plates is symmetrical about the centerline thereof, wherein the shape of the holes formed in the plurality of intermediate plates is asymmetric about the centerline of the intermediate plates, and wherein the plurality of intermediate plates are stacked such that the intermediate plates are alternately reversed about said centerline.

13. The speaker device according to claim 11, wherein the outer shape of the plurality of intermediate plates is a regular polygon, wherein the holes formed in the plurality of intermediate plates are shifted from the center of the intermediate plates, and wherein the plurality of intermediate plates are stacked such that the intermediate plates are successively rotated.

* * * * *